US006087785A

United States Patent [19]

Hsieh et al.

[11] Patent Number: 6,087,785

[45] Date of Patent: Jul. 11, 2000

[54] HARMONIZED STRATEGY FOR ELIMINATING ACOUSTIC RESONANCE IN A FLUORESCENT LAMP

[75] Inventors: Guan-Chyun Hsieh; Chang-Hua Lin, both of Taipei, Taiwan

[73] Assignee: National Science Council, Taipei, Taiwan

[21] Appl. No.: 09/204,368

[22] Filed: Dec. 4, 1998

[30] Foreign Application Priority Data

Sep. 12, 1997 [TW] Taiwan ..... 86118557

[51] Int. Cl.[7] ..... H05B 41/16

[52] U.S. Cl. ..... 315/276; 315/244; 315/209 R; 315/307

[58] Field of Search ..... 315/244, 209 R, 315/205, 276, 227 R, 224, 307

[56] References Cited

U.S. PATENT DOCUMENTS

| | | | |
|---|---|---|---|
| 5,623,187 | 4/1997 | Caldeira et al. | 315/307 |
| 5,773,937 | 6/1998 | Miyazaki et al. | 315/246 |
| 5,859,505 | 1/1999 | Bergman et al. | 315/307 |

*Primary Examiner*—Haissa Philogene
*Attorney, Agent, or Firm*—Harold L. Novick; Nath & Associates

[57] ABSTRACT

A technology for eliminating acoustic resonance in a fluorescent lamp is disclosed in the present invention. The feature of the invention is to provide a harmonic compensating device to work with the fluorescent lamp and its relative peripheral circuits, such that current-dependent sources are provided to modulate the current in the lamp, thereby spreading the harmonic energy of the current in the lamp and eliminating acoustic resonance.

14 Claims, 7 Drawing Sheets

VGS1
t

VGS2
t

I 1
t

I 3
t n|I 3|
t

I lamp
t t0 t1 t2 t3 t4 t5 t6
Cycle

HARMONIZED STRATEGY FOR ELIMINATING ACOUSTIC RESONANCE IN A FLUORESCENT LAMP

BACKGROUND OF THE INVENTION

1. Field of the Invention

The present invention generally relates to a lighting device. More particularly, the present invention relates to a harmonized strategy used in a lighting device for eliminating acoustic resonance in a fluorescent lamp.

2. Description of the Related Art

Gas-discharging lamps have been the most prevalent lighting sources since their development in the 1930's. They possess advantageous features including high color rendering, soft-visualization, and low energy consumption, etc. Today, fluorescent lamps are still commonly used.

A general configuration of a lighting apparatus using a fluorescent lamp is depicted in FIG. 1. Referring to FIG. 1, a voltage source $V_D$ is fed to the fluorescent lamp 10 through the ballast 20. The capacitor $C_S$ disposed across one terminal of the electrode 12*a* and one terminal of the electrode 12*b* serves as a starting capacitor. The inductor $L_R$ connected between the other terminal of the electrode 12*a* and the ballast 20 serves as a resonant inductor. The ballast 20 is comprised by an inverter for providing high frequency (about 20k Hz~65k Hz) driving voltage. Therefore, FIG. 1 shows a general configuration of a series-resonant inverter (SRI) for electronic ballast. Before igniting the fluorescent lamp 10, the inside of the fluorescent lamp 10 is not in a condition state and thus the resonant inductor $L_R$, the filament resistance, and the starting capacitor $C_S$ make up a series-resonant circuit. After igniting the fluorescent lamp 10, the inside of the fluorescent lamp 10 is in a conduction state, and equivalent to resistors shunted with the capacitor $C_S$.

In the last decade, versatile fluorescent lamps have been developed for improving the quality of lighting environments. Nowadays, it is the trend to develop multi-functional lamp systems with dimming control, while maintaining high power quality, to achieve a more comfortable lighting environment for humans. High power factor correction for raising the power quality is available in lamp design. However, when utilizing low-level dimming control, a low frequency snake-like circulation due to acoustic resonance in the lamp inevitably disturbs the dimming performance. This phenomenon is depicted in FIG. 2. Inside the fluorescent lamp 10, the hot electron beam 16 is in a state similar to a standing wave; therefore, the area 18 inside the fluorescent lamp 10 presents darker illumination due to lack of electron stimulation. Moreover, the current in the fluorescent lamp (lamp current) is disturbed and modulated due to the effect of acoustic resonance, resulting in the phenomenon of a standing wave. This phenomenon (acoustic resonance) leads to the igniting of arc voltage in the lamp, which may be unstable, flicker, deform, deflect, and even disappear. Besides, it may disturb the operation of the lamp and raise the lamp temperature.

Three kinds of techniques have been tried to solve the mentioned resonance in the lamp. Zollweg tried to change the gas ingredients or the lamp geometry to eliminate acoustic resonance, as described in the paper "Arc instability in mercury and metal halide arc lamp," J. of the illuminating Eng. Society, pp. 90–94, January 1979. In fact, the method disclosed in Zollweg is difficult to realize practically. Eaehnrich presented a frequency modulation technique to modulate the lamp current to be out of the resonant band, as described in the paper "Electronic ballast for metal halide lamp," J. of the illuminating Eng. Society, pp. 131–141, Summer, 1988. However, the lamp power is unstable and may be changed. Recently, Laskai disclosed an FM PWM strategy to spread the lamp power in different bands and reduce the amplitudes of the spread harmonics in order to eliminate the resonance occurring in the gas-discharging lamp in the paper "A unity power factor electronic ballast for metal halide lamps," Proc. IEEE APEC'94, pp.31–37, 1994. However, it is still useless for spreading the energy of the lower-order harmonics and will result in deterioration of the EMI in the ballast. Therefore, the above methods can not eliminate the acoustic resonance effect when the fluorescent lamp is in a low-level dimming condition.

SUMMARY OF THE INVENTION

The object of the present invention is to provide a technology for eliminating acoustic resonance in the general fluorescent lamp, thereby reducing the phenomenon of snake-like circulation and improving the illumination.

In accordance with the above object, the present invention provides a lighting apparatus with the characteristic of reducing acoustic resonance. This lighting apparatus comprises: a lamp with a first electrode and a second electrode; a starting capacitor coupled between the first electrode and the second electrode; a ballast for transforming an external voltage to feed to the first and second electrodes; a resonant inductor coupled between the ballast and the first electrode; and a harmonic compensating device. The function of the harmonic compensating device is to obtain a reference current corresponding to the lamp current and, according to the lamp current, generates a first compensating current and a second compensating current supplied to the first and second electrodes of the lamp, respectively. Consequently, every harmonic energy of the lamp current can be dispersed due to harmonizing reaction, thereby eliminating the acoustic resonance phenomenon. Moreover, the first and second compensating currents are generated by a full-wave rectifier and the current passing the starting capacitor is obtained by using a coupling transformer.

BRIEF DESCRIPTION OF THE DRAWINGS

Other objects, features and advantages of the present invention will become apparent by way of the following detailed description of the preferred but non-limiting embodiment. The description is made with reference to the accompanying drawings.

DETAILED DESCRIPTION OF THE INVENTION

In the present invention, a harmonized strategy is used to eliminate acoustic resonance. In other words, a harmonic compensating circuit is used for generating compensating currents of a current-dependent source, and the compensating currents are fed to two electrodes of the fluorescent lamp, respectively. Therefore, the lamp current is modulated such that the energy of the lamp current is distributed to different harmonic components. Because the energy is not concentrated at a specific frequency, the possibility of generating a standing-wave inside the lamp due to acoustic resonance is reduced as much as possible, thereby achieving the object of the present invention. The present invention will be described by way of a preferred but non-limiting embodiment in accompaniment with the drawings.

Figure 1:
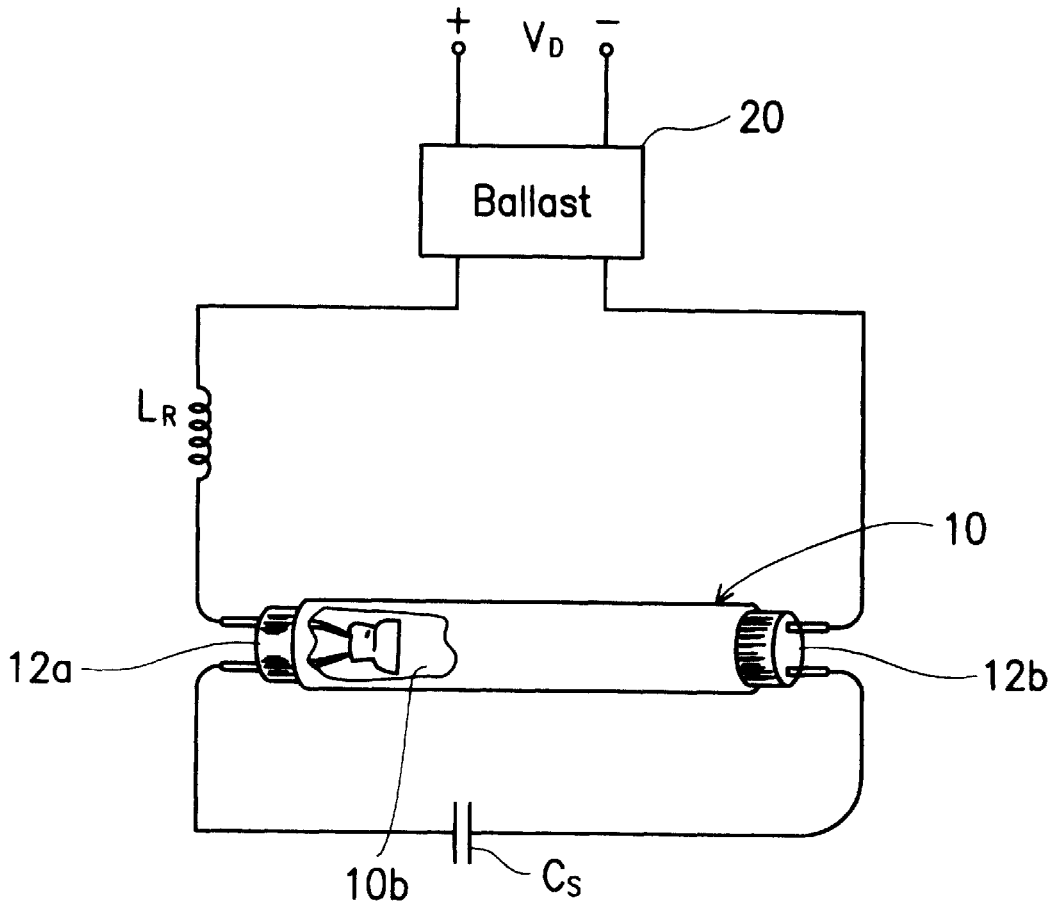
FIG. 1 (PRIOR ART)
FIG. 1 illustrates a general lighting apparatus with a fluorescent lamp.
Figure 2:
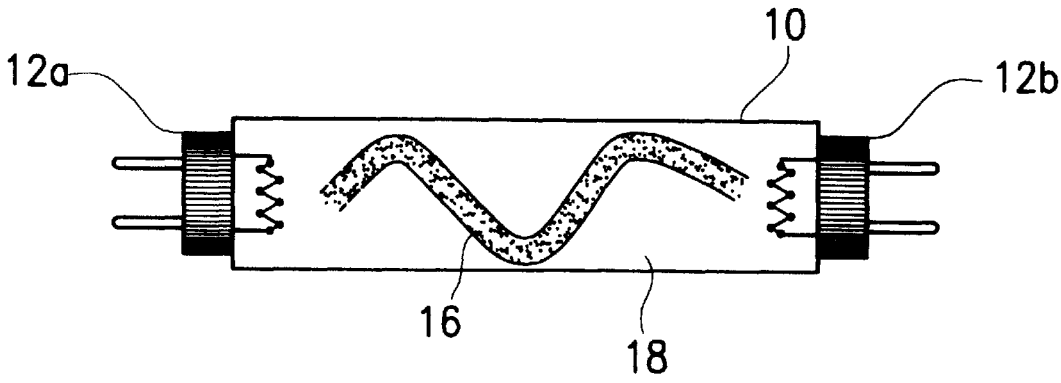
FIG. 2 (PRIOR ART)
FIG. 2 illustrates the snake-like circulation phenomenon when a general fluorescent lamp is in a low level dimming condition.
Figure 3:
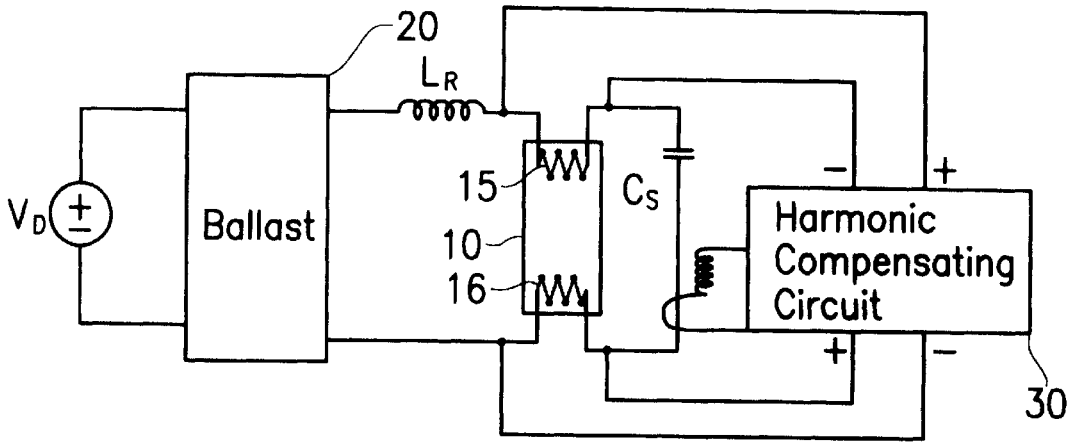
FIG. 3 schematically illustrates the circuit block diagram of the lighting apparatus with the characteristic of reducing acoustic resonance.

FIG. 3 schematically illustrates the circuit topology of the embodiment with the characteristic of reducing acoustic resonance. In FIG. 3, the external voltage source $V_D$, the ballast 20, the resonant inductor $L_R$, the fluorescent lamp 10, and the starting capacitor $C_S$ are the conventional components applied in general lighting apparatuses. Two electrodes of the fluorescent lamp 10 are represented by two filaments 15 and 16 respectively. The harmonic compensating circuit 30 is the main feature of the present invention. The harmonic compensating circuit 30 receives a coupling current in response to the current passing through the starting capacitor $C_S$ by way of a coupling device (for example a coupling transformer), and the coupling current (and the capacitor current) depends on the current (lamp current) inside the fluorescent lamp 10. Then, two compensating currents are generated according to the coupling current and transmitted to one loop containing the filament 15 and the other loop containing the filament 16, respectively. After the lamp current is modulated by the two compensating currents, the energy of the lamp current spreads at different harmonics and thus acoustic resonance disappears.

Figure 4:
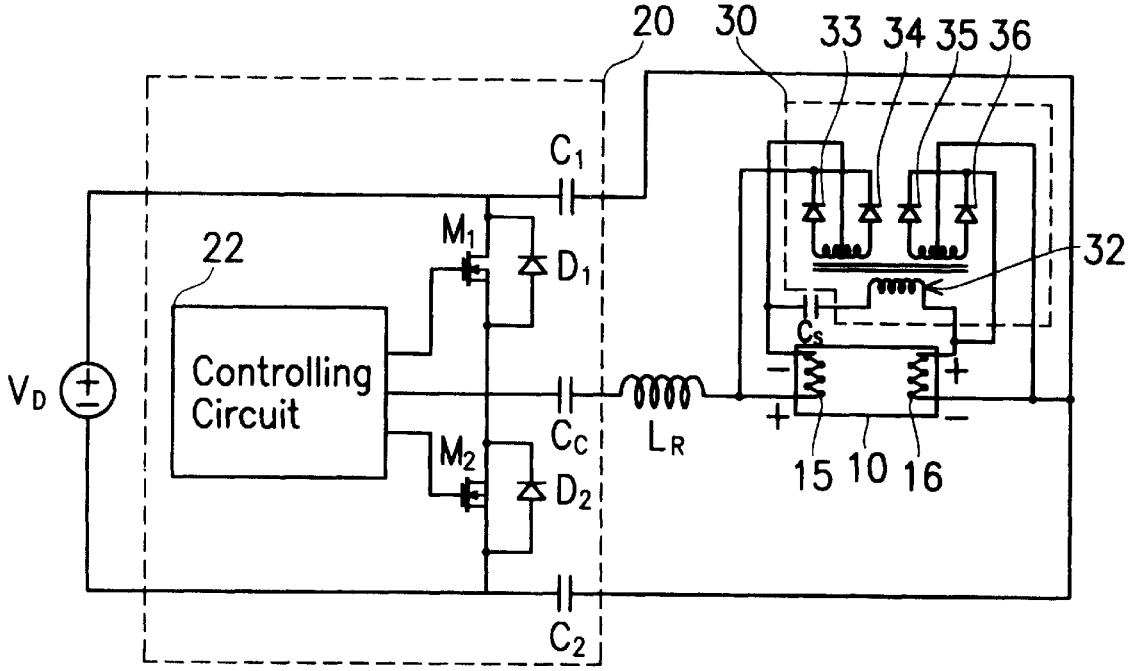
FIG. 4 illustrates the detailed circuitry of the lighting apparatus with the characteristic or reducing acoustic resonance.
Figures 7A, 7B, 7C, 7D, 7E, 7F:
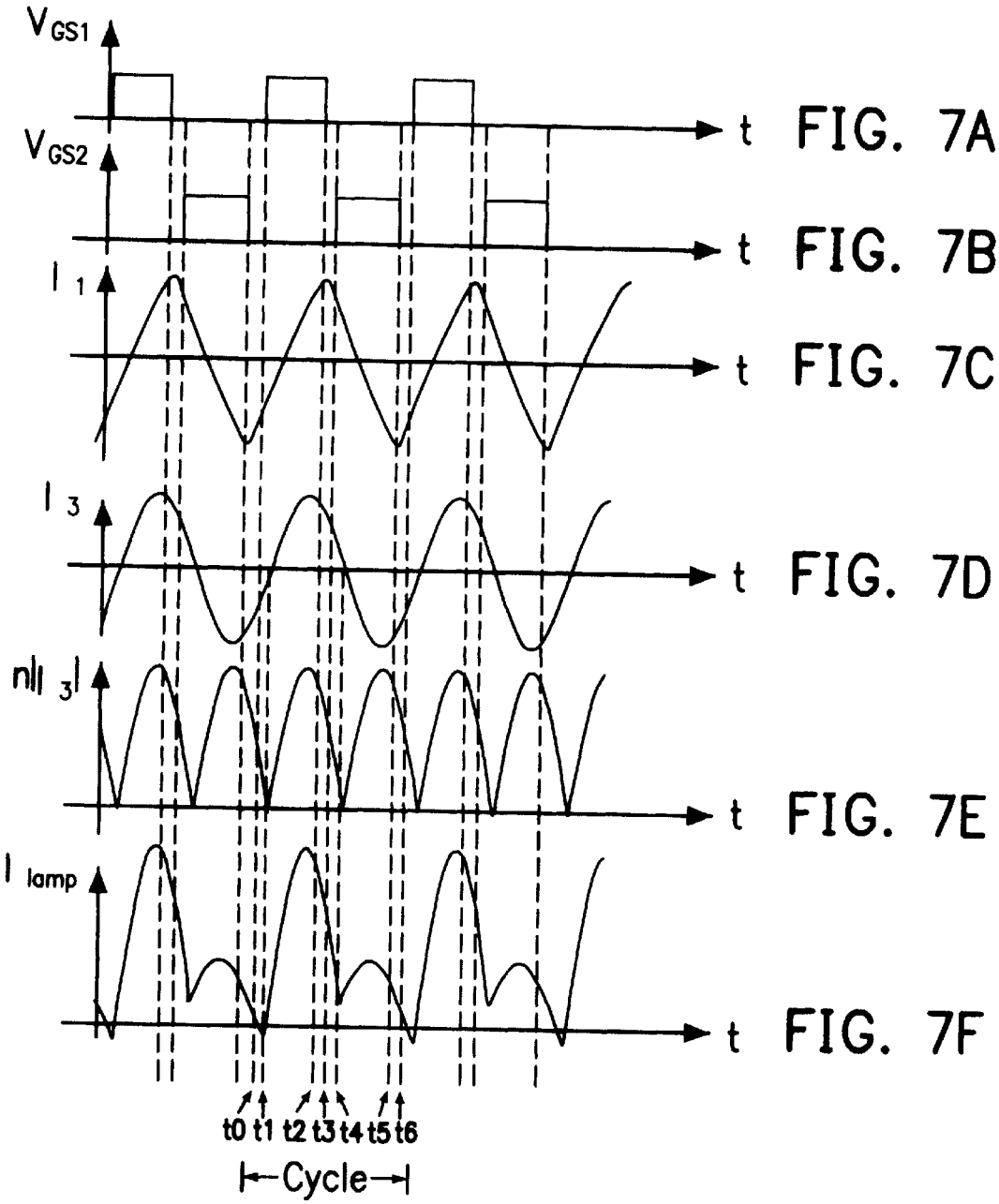
FIG. 7A to FIG. 7F illustrate the signal charts of a first controlling signal $V_{GS1}$, a second controlling signal $V_{GS2}$, a current $I_1$, a current $I_3$, a compensating circuit $n|I_3|$, and a lamp current $I_{lamp}$ respectively.

FIG. 4 illustrates the detailed circuit topology of the embodiment according to the present invention. In this embodiment, the ballast 20 is based on the topology of the half-bridge series-resonant inverter (HB-SRI). In FIG. 4, the ballast 20 comprises a controlling circuit 22, transistors M1 and M2, parasitic diodes D1 and D2, and capacitors C1, C2 and $C_C$. The controlling circuit 22 generates a first controlling signal $V_{GS1}$ and a second controlling signal $V_{GS2}$ (as shown in FIGS. 7A and 7B) and supplies them to the transistors M1 and M2 for controlling on and off states, respectively. The transferring frequency of the external voltage $V_D$ is determined by the on-off switching frequency of the transistors M1 and M2. The harmonic compensating circuit 30 comprises a coupling transformer 32, a first full-wave rectifier including diodes 33 and 34, and a second full-wave rectifier including diodes 35 and 36. The current flowing through the starting capacitor $C_S$ is coupled to the first and second full-wave rectifiers respectively by way of the coupling transformer 32. The actual value of the coupling current is in proportional to the turn ratio (n) of the coupling transformer. The coupling current (n times as large as the starting capacitor current) is full-wave rectified by the first full-wave rectifier (including diodes 33 and 34), and then fed back to the loop containing the filament 15. In addition, the coupling current (n times as large as the starting capacitor current) is full-wave rectified by the second full-wave rectifier (including diodes 35 and 36), and then fed back to the loop containing the filament 16. Finally, the lamp current is modulated by the compensating current sent from two full-wave rectifiers such that the energy of the lamp current spreads, thereby breaking acoustic resonance in the lamp.

For convenience in analysis, the circuit depicted in FIG. 4 is transferred to an analyzable equivalent circuit.

Figure 5A:
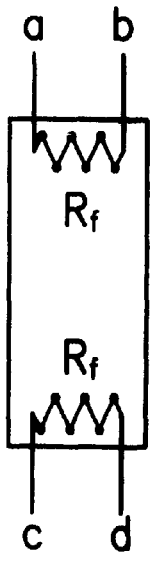
FIG. 5A illustrates the equivalent circuit of a general fluorescent lamp before igniting.
Figure 5B:
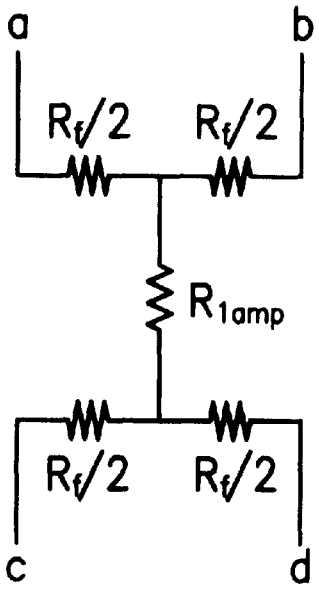
FIG. 5B illustrates the equivalent circuit of a general fluorescent lamp after igniting.

FIGS. 5A and 5B illustrate the equivalent circuits of the fluorescent lamp 10 before and after igniting the lamp 10 respectively. In FIG. 5A, in the inside of the lamp 10 is in off state, therefore in the inside of the lamp 10 between the two electrodes (a-b terminal and c-d terminal) is open-circuited. The impedance of the filament is represented as $R_f$. In FIG. 5B, in the inside of the lamp 10 is in on state (i.e., a current passing the lamp 10), therefore in the inside of the lamp 10 between the two electrodes (a-b terminal and c-d terminal) can be represented by an impedance $R_{lamp}$.

Figure 5C:
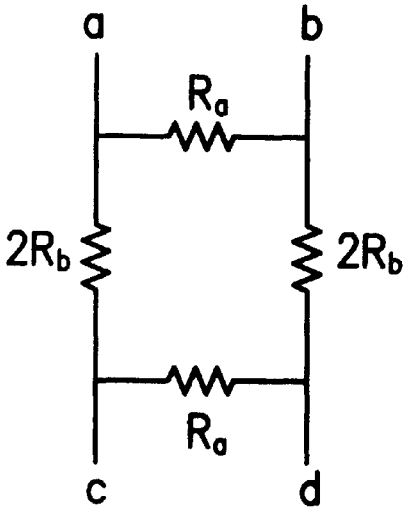
FIG. 5C illustrates the equivalent circuit of the general fluorescent lamp in the present invention after igniting.

By way of Y-Δ transformation, the equivalent circuit depicted in FIG. 5B is transferred into the circuit depicted in FIG. 5C. Referring to FIG. 5B, two resistors (both with resistance $R_f/2$) across the a-b terminal and one half of the lamp resistor $R_{lamp}$ make up one Y network, and two resistors (both with resistance $R_f/2$) across the c-d terminal and the other half of the lamp resistor $R_{lamp}$ make up another Y network. The two Y networks are first transferred into Δ networks, then simplified as the circuit depicted in FIG. 5C. In FIG. 5C, the resistance $R_a$ and $R_b$ can be represented as:

$$R_a = \frac{\frac{R_f^2}{2} + R_f R_{lamp}}{R_{lamp}}, \text{ and}$$

$$R_b = \frac{\frac{R_f^2}{2} + R_f R_{lamp}}{R_f}.$$

The harmonic compensating circuit 30 is transferred into its equivalent circuit as follows. As depicted in FIG. 4, the harmonic compensating circuit 30 equivalently includes two dependent current sources which provide currents to two electrodes of the lamp 10, and the values of the currents equal n times the absolute value of the current passing through the starting capacitor $C_S$, wherein n is the turn ratio of the coupling transformer.

The ballast 20 and external voltage $V_D$ are transferred into their equivalent circuit as follows. In FIG. 4, the controlling circuit 22 is used to control the on and off states of the transistors M1 and M2 by controlling signals $V_{GS1}$ and $V_{GS2}$. The controlling signals $V_{GS1}$ and $V_{GS2}$ are non-interlaced pulse signals as depicted in FIGS. 7A and 7B, such that the ballast 20 and external voltage source $V_D$ have the following features: when the controlling signal $V_{GS1}$ is positive, the equivalent voltage source is positive $(½)V_D$; when the controlling signal $V_{GS2}$ is positive, the equivalent voltage source is negative $(½)V_D$; and when both the controlling signals $V_{GS1}$ and $V_{GS2}$ are zero, the equivalent voltage source is zero.

Figure 6:
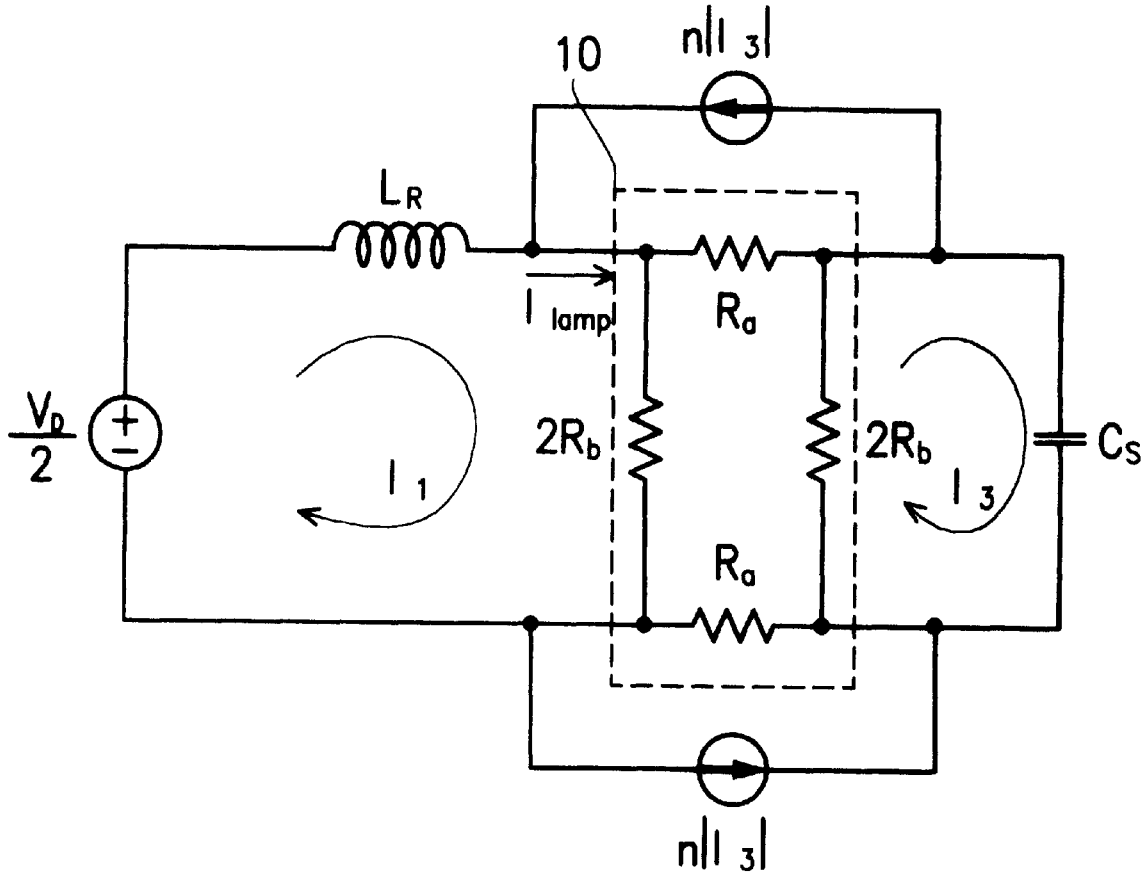
FIG. 6 illustrates the equivalent circuit of an embodiment according to the present invention.

According to the descriptions of the equivalent circuit transfers, the circuit depicted in FIG. 4 is equivalent to the circuit depicted in FIG. 6. In FIG. 6, the fluorescent lamp 10 is simulated by using the network made up of resistors $R_a$ and $R_b$. Moreover, provided that the current passing the resonant inductor $L_R$ is $I_1$, the current passing the starting capacitor $C_S$ is $I_3$, and the current flowing in the fluorescent lamp 10 is $I_{lamp}$. Consequently, two dependent current sources representing the harmonic compensating circuit 30 are represented by using two current sources, both with the same current value of $n|I_3|$, disposed across two terminals of the fluorescent lamp 10. By way of the equivalent circuit in FIG. 6 and the general network analysis, the inductor current $I_1$, the capacitor current $I_3$, the dependent current source $n|I_3|$, and the actual lamp current $I_{lamp}$ are illustrated in FIGS. 7C, 7D, 7E, and 7F.

In FIGS. 7A to 7F, the time interval t0 to t6 represent one cycle (period). The times t0, t1, t2, t3, t4, and t5 respectively represent the times when the controlling signal $V_{GS1}$ changes from zero to positive voltage, when the capacitor current $I_3$ changes from negative to positive, when the controlling signal $V_{GS1}$ changes from positive voltage to zero, when the controlling signal $V_{GS2}$ changes from zero to positive voltage, when the capacitor current $I_3$ changes from positive to negative, and when the controlling signal $V_{GS2}$ changes from positive voltage to zero. According to the periodicity of the controlling signals, a corresponding periodic current can be generated in the lamp current $I_{lamp}$. From FIG. 7F, it is observed that the lamp current $I_{lamp}$ has more harmonic components.

Figure 8A:
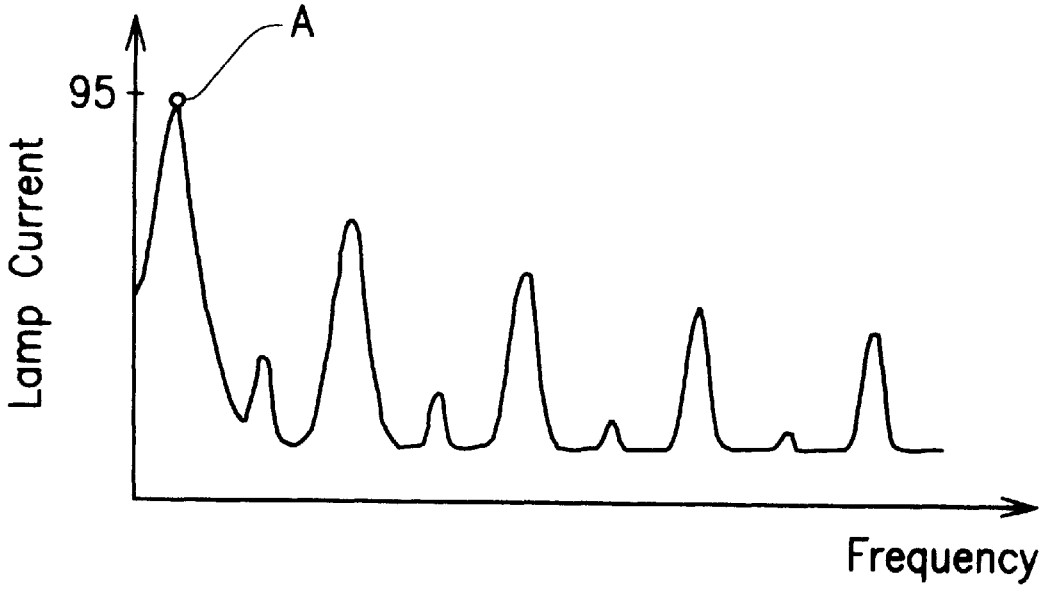
FIG. 8A (PRIOR ART)
FIG. 8A and FIG. 8B illustrate respectively the frequency and time responses of the lamp current in the prior art.
Figure 8B:
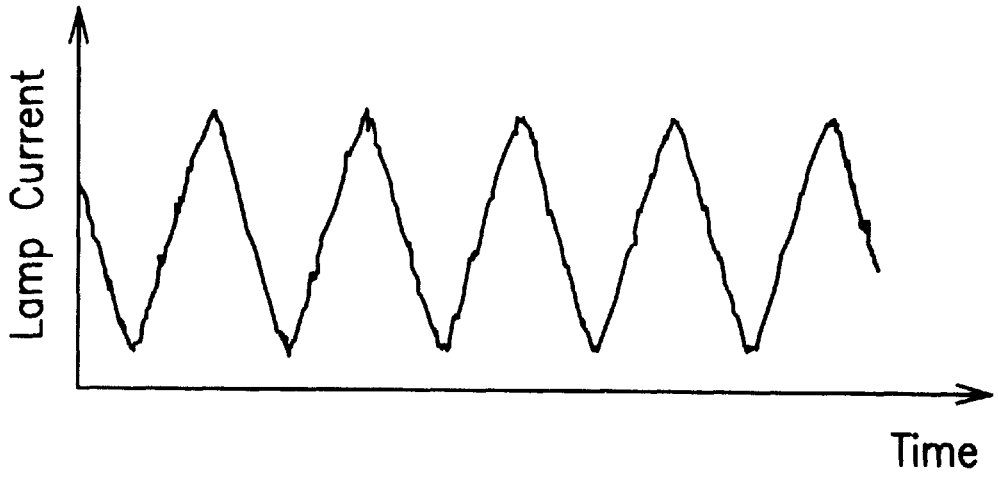
FIG. 8B (PRIOR ART)
Figure 9A:
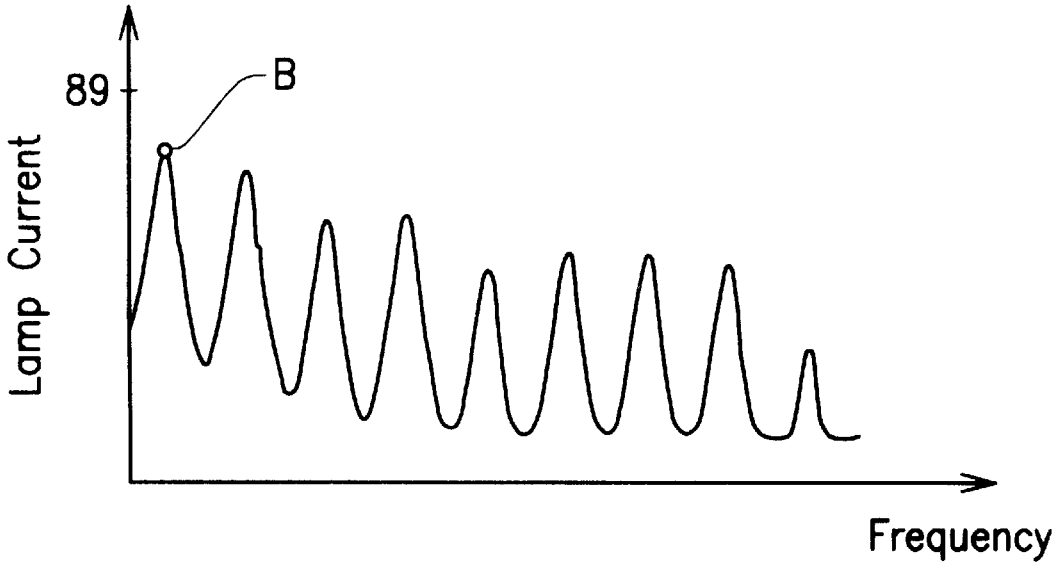
FIG. 9A and FIG. 9B illustrate respectively the frequency and time responses of the lamp current in the present invention.
Figure 9B:
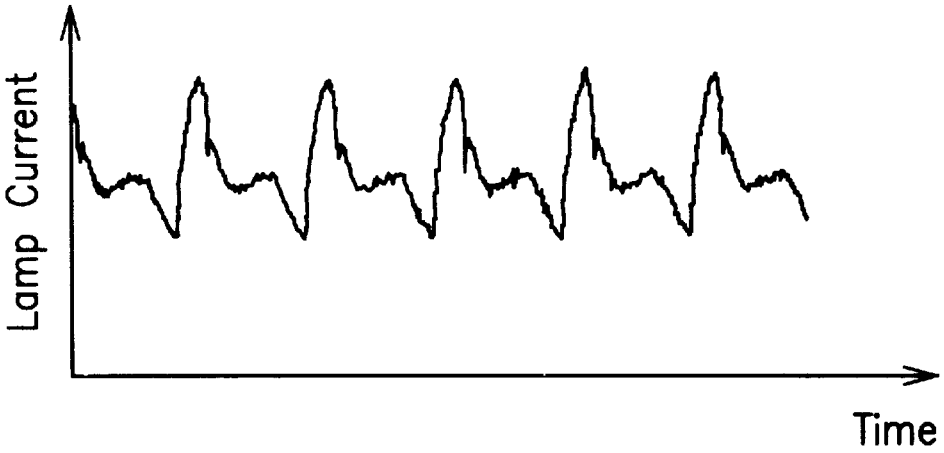

FIG. 8A and FIG. 8B respectively illustrate the frequency and time responses of the lamp current in the prior art. FIG. 9A and FIG. 9B respectively illustrate the frequency and time responses of the lamp current $I_{lamp}$ when the harmonic compensating circuit 30 is applied in the present invention. In the examples of FIGS. 8 and 9, the inductance of the resonant inductor $L_R$ is 2.05 mH, the capacitance of the starting capacitor CS is 8.2 nF, and the switching frequency of the ballast 20 is 56k Hz. In FIG. 8A, the current amplitude of the fundamental harmonics is about 95 dB (at A point) and is relatively higher than the other harmonics. The same result also can be seen from the time response in FIG. 8B. However, in FIG. 9A, the current amplitude of the fundamental harmonics is lowered down to about 89 dB (at B point) and because the current amplitudes of the other harmonics also increase, the current amplitude of the fundamental harmonics is not relatively high with respect to the other harmonics. The same result also can be seen from the time response in FIG. 9B.

The harmonic currents (with harmonic orders from 1 to 90 making up to the lamp currents $I_{lamp}$ in the prior art (without a harmonic compensating circuit) and the present invention) with a harmonic compensating circuit) are compared and listed respectively in table I, wherein the unit of the current value is mA.

TABLE I

| Harmonic order | Prior art | Present invention |
|---|---|---|
| 1 | 56.23 | 20.00 |
| 2 | 0.20 | 19.95 |
| 3 | 4.50 | 5.60 |
| 4 | 0.06 | 6.30 |
| 5 | 1.00 | 1.40 |
| 6 | 0.00 | 2.50 |
| 7 | 0.40 | 2.24 |
| 8 | 0.00 | 1.78 |
| 9 | 0.22 | 0.20 |

From the above descriptions, it is obvious that the energy of the fundamental harmonic current is distributed to the other harmonic currents by way of the harmonic compensating circuit, thereby eliminating acoustic resonance.

While the invention has been described in terms of what is presently considered to be the most practical and preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A lighting apparatus using harmonized strategy for eliminating acoustic resonance comprising:

a lamp with a first electrode and a second electrode;

a starting capacitor coupled between said first and second electrodes;

a ballast for transforming an external voltage, thereby supplying voltage to said first and second electrodes of said lamp;

a resonant inductor coupled between said ballast and one of the electrodes of said lamp; and a harmonic compensating device which samples a reference current corresponding to the current flowing in said lamp and generates a first compensating current and a second compensating current according to said reference current, said first and second compensating currents being fed to said first and second electrodes, thereby spreading the harmonic energy of the current in said lamp and eliminating acoustic resonance.

2. The apparatus as claimed in claim 1, wherein said ballast has the configuration of a half-bridge series-resonant inverter.

3. The apparatus as claimed in claim 1, wherein said harmonic compensating device is provided between said starting capacitor and said lamp for sampling said reference corresponding to the current flowing in said lamp.

4. The apparatus as claimed in claim 1, wherein said first electrode has a first terminal and a second terminal, and said second electrode has a third terminal and a fourth terminal; said harmonic compensating device outputting said first compensating current by way of the loop made up of said first and second terminals, and outputting said second compensating current by way of the loop made up of said third and fourth terminals.

5. The apparatus as claimed in claim 1, wherein said harmonic compensating device comprises:

a coupling transformer for coupling said lamp and sampling said reference current;

a first full-wave rectifier which rectifies said reference current for generating said first compensating current and outputs said first compensating current to said first electrode;

a second full-wave rectifier which rectifies said reference current for generating said second compensating current and outputs said second compensating current to said second electrode.

6. The apparatus as claimed in claim 6, wherein said coupling transformer is provided between said lamp and said starting capacitor.

7. The apparatus as claimed in claim 1, wherein said lamp is a fluorescent lamp.

8. A lighting apparatus using harmonized strategy for eliminating acoustic resonance comprising:

a lamp with a first electrode and a second electrode; and a harmonic compensating device which samples a reference current corresponding to the current flowing in said lamp and generates a first compensating current and a second compensating current according to said reference current, said compensating current being fed to said first and second electrodes of said lamp to spread the harmonic energy of the current in said lamp and eliminate acoustic resonance.

9. The apparatus as claimed in claim 8, further comprising a ballast for transferring an external voltage and supply voltage to said lamp.

10. The apparatus as claimed in claim 8, further comprising a starting capacitor shunted between said first and second electrodes in parallel, wherein said harmonic compensating device samples said reference current by way of said starting capacitor.

11. The apparatus as claimed in claim 8, wherein said harmonic compensating device comprises:

a coupling transformer for coupling said lamp and sampling said reference current;

a first full-wave rectifier which rectifies said reference current for generating said first compensating current and outputs said first compensating current to said first electrode;

a second full-wave rectifier which rectifies said reference current for generating said second compensating current and outputs said second compensating current to said second electrode.

12. The apparatus as claimed in claim 8, wherein said lamp is a fluorescent lamp.

13. An apparats for eliminating acoustic resonance appropriate for a gas-discharging lamp with a first and second electrode, said apparatus comprising:

a coupling transformer for coupling said gas-discharging lamp and sampling a reference current corresponding to the current flowing in said gas-discharging lamp;

a first full-wave rectifier which rectifies said reference current for generating a first compensating current and outputs said first compensating current to said first electrode; and a second full-wave rectifier which rectifies said reference current for generating a second compensating current and outputs said second compensating current to said second electrode;

wherein said first and second compensating currents spread the harmonic energy of the current in said gas-discharging lamp eliminating acoustic resonance.

14. The apparatus as claimed in claim 13, wherein said first electrode has a first terminal and a second terminal, and said second electrode has a third terminal and a fourth terminal, a harmonic compensating device outputting said first compensating current by way of a loop made up of said first and second terminals, and outputting said second compensating current by way of a loop made up of said third and fourth terminals.

* * * * *